US007169270B2

(12) United States Patent
D'Astolfo, Jr. et al.

(10) Patent No.: US 7,169,270 B2
(45) Date of Patent: Jan. 30, 2007

(54) INERT ANODE ELECTRICAL CONNECTION

(75) Inventors: LeRoy E. D'Astolfo, Jr., Lower Burrell, PA (US); R. Lee Troup, Murrysville, PA (US)

(73) Assignee: Alcoa, Inc., Pittsburgh, PA (US)

( * ) Notice: Subject to any disclaimer, the term of this patent is extended or adjusted under 35 U.S.C. 154(b) by 352 days.

(21) Appl. No.: 10/797,170

(22) Filed: Mar. 9, 2004

(65) Prior Publication Data

US 2005/0199508 A1 Sep. 15, 2005

(51) Int. Cl.
*C25B 11/02* (2006.01)

(52) U.S. Cl. ..... 204/280; 204/286.1; 204/291; 204/292; 204/293; 29/746

(58) Field of Classification Search ..... 205/372, 205/380, 384, 385, 387, 388; 204/243.1, 204/280; 29/746
See application file for complete search history.

(56) References Cited

U.S. PATENT DOCUMENTS

| | | | | |
|---|---|---|---|---|
| 4,374,050 | A | 2/1983 | Ray | 252/519 |
| 4,374,761 | A | 2/1983 | Ray | 252/519 |
| 4,399,008 | A | 8/1983 | Ray | 204/67 |
| 4,450,061 | A | 5/1984 | Rolf | 204/286 |
| 4,455,211 | A | 6/1984 | Ray et al. | 204/293 |
| 4,457,811 | A | 7/1984 | Byrne | 204/60 |
| 4,468,298 | A | 8/1984 | Byrne et al. | 204/60 |
| 4,468,299 | A | 8/1984 | Byrne et al. | 204/60 |
| 4,468,300 | A | 8/1984 | Byrne et al. | 204/60 |
| 4,500,406 | A | 2/1985 | Weyand et al. | 204/293 |
| 4,515,674 | A | 5/1985 | Takahashi | 204/292 |
| 4,582,585 | A | 4/1986 | Ray | 204/243 R |
| 4,584,172 | A | 4/1986 | Ray et al. | 419/34 |
| 4,620,905 | A | 11/1986 | Tarcy et al. | 204/64 R |
| 5,794,112 | A | 8/1998 | Ray et al. | 419/21 |
| 5,865,980 | A | 2/1999 | Ray et al. | 205/367 |
| 6,126,799 | A | 10/2000 | Ray et al. | 204/291 |
| 6,217,739 | B1 | 4/2001 | Ray et al. | 205/385 |
| 6,372,119 | B1 | 4/2002 | Ray et al. | 205/387 |
| 6,416,649 | B1 | 7/2002 | Ray et al. | 205/387 |
| 6,423,195 | B1 | 7/2002 | Ray et al. | 204/291 |
| 6,423,204 | B1 | 7/2002 | Ray et al. | 205/387 |
| 6,878,246 | B2 * | 4/2005 | Latvaitis et al. | 204/280 |
| 2001/0035344 | A1 * | 11/2001 | D'Astolfo et al. | 204/243.1 |
| 2001/0037946 | A1 * | 11/2001 | D'Astolfo et al. | 205/389 |

* cited by examiner

*Primary Examiner*—Bruce F. Bell
(74) *Attorney, Agent, or Firm*—Greenberg Traurig, LLP

(57) ABSTRACT

An improved electrical connection between an inert anode and a conductor rod is disclosed. The conductor rod has a smaller diameter than a hole in the anode such that a gap is provided between the conductor rod and the anode. The gap is filled with an electrically conductive particulate material, such as Cu, Ni and/or Ag. The particulate conductor material is at least partially sintered before or during operation of the anode. To ensure a good connection between the conductor rod and the anode, the particle size distribution of the particulate connector material may be controlled.

40 Claims, 5 Drawing Sheets

INERT ANODE ELECTRICAL CONNECTION

FIELD OF THE INVENTION

The present invention relates to inert anode assemblies for use in electrolytic metal production cells, and more particularly relates to electrical connections for such inert anode assemblies.

BACKGROUND OF THE INVENTION

The energy and cost efficiency of aluminum smelting can be significantly reduced with the use of inert, non-consumable and dimensionally stable anodes. Replacement of traditional carbon anodes with inert anodes should allow a highly productive cell design to be utilized, thereby reducing capital costs. Significant environmental benefits are also possible because inert anodes produce no $CO_2$ or $CF_4$ emissions. Some examples of inert anode compositions are provided in U.S. Pat. Nos. 4,374,050, 4,374,761, 4,399,008, 4,455,211, 4,582,585, 4,584,172, 4,620,905, 5,794,112, 5,865,980, 6,126,799, 6,217,739, 6,372,119, 6,416,649, 6,423,204 and 6,423,195, assigned to the assignee of the present application. These patents are incorporated herein by reference.

Inert anodes must be electrically connected to conductors that are typically made of metal such as nickel, Inconel or steel. However, making a low voltage drop electrical connection between a metallic conductor and an inert anode comprising a ceramic or ceramic-metallic (cermet) is a challenge. The connection must be maintained with good integrity (low voltage drop) over a wide range of temperatures and operating conditions. One type of connection could utilize a precision mechanical connection between the ceramic anode and metal conductor, such that an interference is developed above a certain desired temperature. This type of connection has several drawbacks. It requires smooth surfaces and tight tolerances of both the metallic and ceramic surfaces, which can only be done with expensive precision machining. In addition, the connections must typically use matched anode/conductor sets, so the parts are not interchangeable. This type of connection also causes internal stresses on the anode, which could contribute to cracking or failure of the anode. Finally, the connection must be kept clean and free of foreign particles that would interfere with the contact.

The present invention has been developed in view of the foregoing.

SUMMARY OF THE INVENTION

The present invention provides an improved electrical connection between an inert anode and a conductor rod. In one embodiment, the conductor rod has a smaller diameter than a hole in the anode. The gap is filled with an electrically conductive powder and/or shot, such as Cu, Ni and/or Ag, followed by full or partial sintering either before or during use of the inert anode in the aluminum production cell. To ensure a good connection between the conductor rod and the anode, the particle size distribution of the particulate connector material may be controlled. For example, the particulate connector material may consist of multiple particle size distributions for maximum packing efficiency and minimum sintering shrinkage. In an embodiment of the invention, a metal coating such as Ag, Cu and/or Ni may be utilized on the walls of the anode and/or conductor rod to promote bonding and electrical contact between the particulate connector material and electrode wall.

An aspect of the presentation is to provide an inert anode assembly comprising an inert anode having a cavity, an electrically conductive rod at least partially disposed in the cavity defining a gap between the inert anode and the conductive rod, and particulate conductor material at least partially filling the gap.

Another aspect of the present invention is to provide a method of making an inert anode assembly. The method includes the steps of providing an inert anode comprising a cavity, providing an electrically conductive rod at least partially in the cavity with a gap between the inert anode and the conductive rod, and providing a particulate connector material in the gap.

A further aspect of the present invention is to provide a method of producing aluminum. The method comprises passing current between an inert anode assembly and a cathode through a molten salt bath comprising an electrolyte and aluminum oxide, and recovering aluminum from the molten salt bath. The inert anode assembly comprises an inert anode having a cavity, an electrically conductive rod at least partially disposed in the cavity defining a gap between the inert anode and the conductive rod, and particulate conductor material at least partially filling the gap.

These and other aspects of the present invention will be more apparent from the following description.

DETAILED DESCRIPTION

Figure 1:
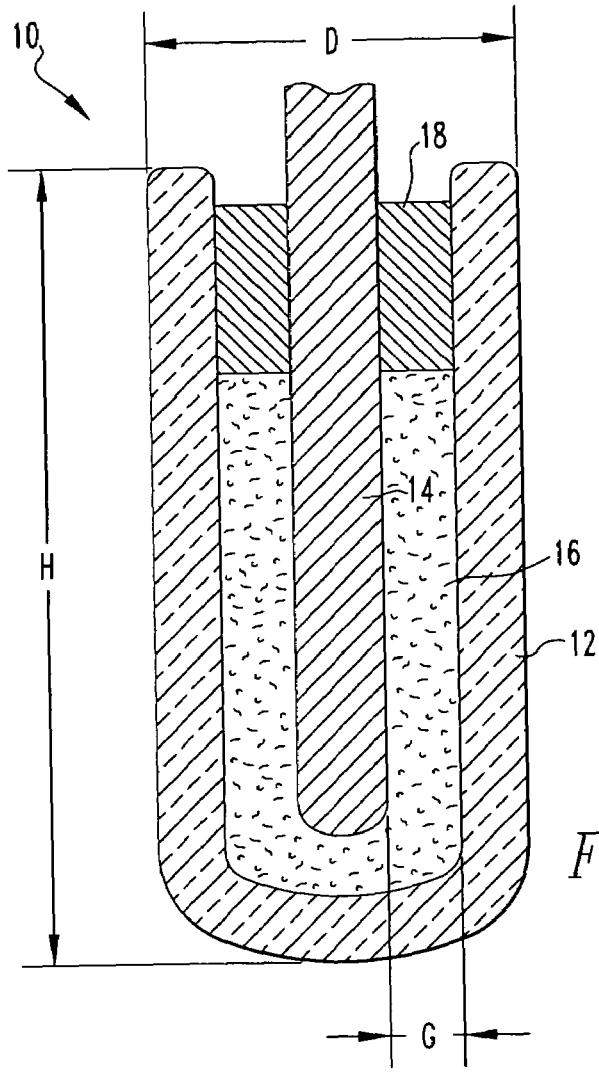
FIG. 1 is a side sectional view of an inert anode electrical connection in accordance with an embodiment of the present invention.

FIG. 1 is a side sectional view of an inert anode connector assembly 10 in accordance with an embodiment of the present invention. The assembly 10 includes a generally cylindrical, cup-shaped inert anode 12 surrounding a conductor rod 14. A particulate connector material 16 in accordance with the present invention fills the gap G between the inner surface of the anode 12 and the rod 14. A seal 18 is provided inside the anode 12 above the connector material 16.

As shown in FIG. 1, the inert anode 12 has a height H that typically ranges from about 10 to about 40 cm, typically from about 15 to about 30 cm. The inert anode 12 has a diameter D that typically ranges from about 4 to about 30 cm, preferably from about 5 to 15 cm. The gap G between the conductor rod 14 and the inner surface of the anode 12 may range from about 0.1 to about 15 cm, typically from about 0.25 to about 6 cm. In a particularly preferred embodiment, the gap G is from about 0.6 to about 1.3 cm. The gap G typically ranges from about 0.5 to 5 times the diameter of the conductor rod 14.

In accordance with the present invention, the particulate connector material 16 may comprise particles of electrically conductive material such as Cu, Ni, Ag, Fe, Al, bronze, Monel (e.g., Ni-400, Ni-450, etc.) and Inconel (e.g., Ni-600, etc.), as well as alloys thereof. Copper is a preferred material due to its high conductivity and low sintering temperature, but Ni, Fe, Monel or other metals and alloys can be used alone or in combination with copper. The particulate connector material 16 may have an average particle size of from about 0.05 or 0.1 to about 5 mm, typically from about 0.2 to about 2 mm. The particles may be provided in the form of equiaxed particles, spheres, rods, whiskers, platelets and the like. For example, the particles may be spheroidal with relatively smooth surfaces.

The density of the particulate connector material prior to sintering is typically less than 95 percent of the theoretical density of the connector material, for example, less than 90 percent. The density of the particulate connector material is typically greater than 50 percent of the theoretical density of the connector material, for example, greater than 60 percent.

Figure 3:
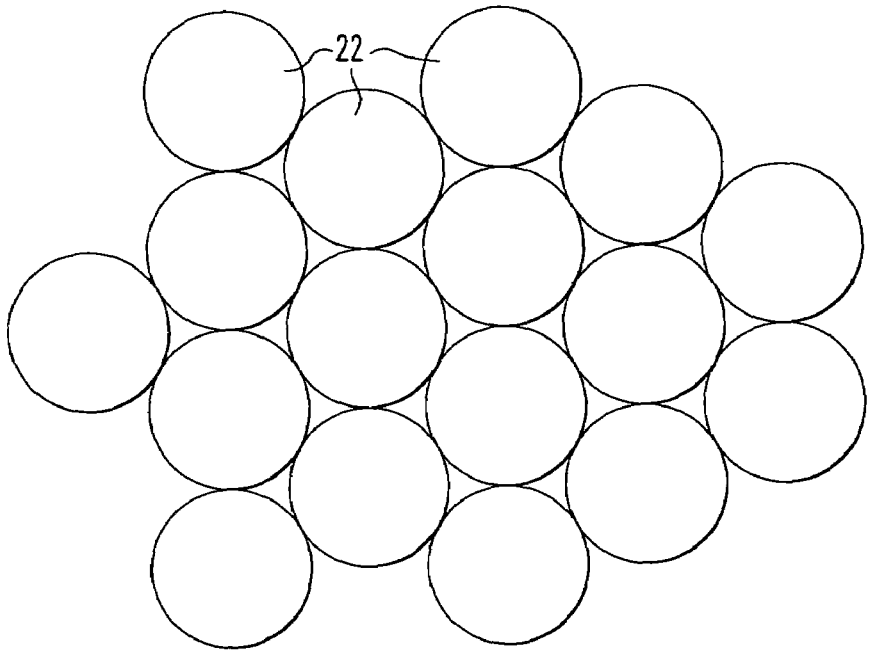
FIG. 3 is a partially schematic illustration of a particulate connector material in accordance with an embodiment of the present invention.

The particulate connector material 16 may have a controlled particle size distribution. For example, the particulate material may have a narrow size distribution in which substantially all of the particles have diameters within 50 percent of the average particle size. An example of particles 22 having such a monomodal narrow particle size distribution is schematically shown in FIG. 3.

It may be desirable to reduce or eliminate the number of fines, e.g., particles having diameters of less than 0.1 mm, in order to reduce shrinkage and improve uniformity upon subsequent sintering of the particles.

In accordance with an embodiment of the present invention, the green bulk density of the particulate connector material 16 filling the gap G can be increased by uniformly mixing particles of significantly different sizes, compared to particles with a monosized particle size distribution. The particulate connector material 16 may thus comprise multiple particle size distributions. A large increase in density may be obtained by using, e.g., a bimodal particle size distribution consisting of an approximately monosize distribution of large particles infiltrated with an approximately monosized distribution of smaller particles.

Figure 4:
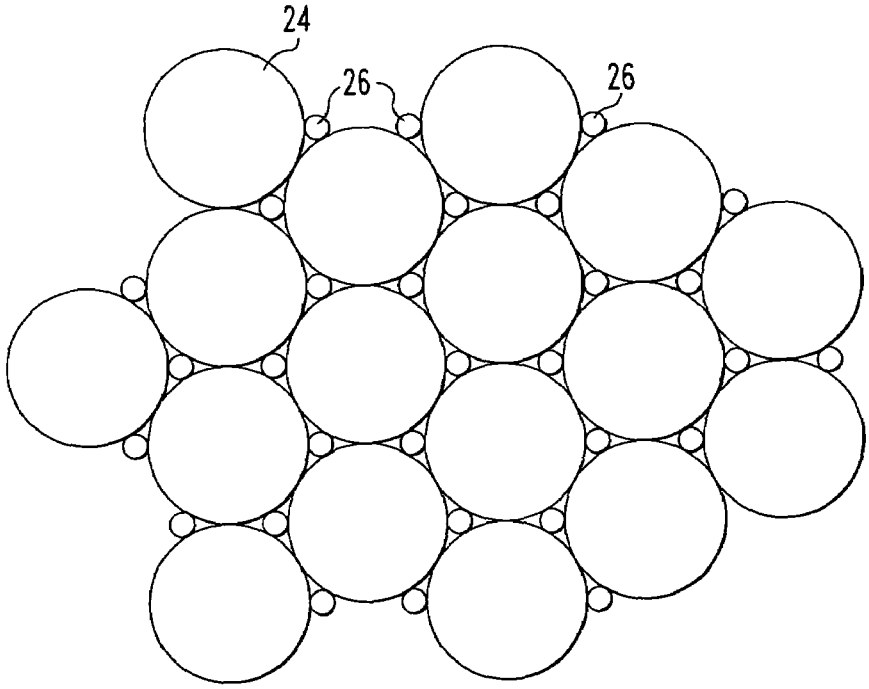
FIG. 4 is a partially schematic illustration of a particulate connector material in accordance with another embodiment of the present invention.

An example of a bimodal particle size distribution is schematically shown in FIG. 4. The differences in average diameters of the two monosized particle size distributions may be at least 4:1, preferably greater than 10:1. The smaller particles 26 of the particulate connector material 16 may fit in the interstices between the larger particles 24. For the bimodal distribution, a maximum green density and minimum sintered density may be obtained at about 75 percent large particles and 25 percent small particles. This results in a sintered density that is close to the green density. Normally, such a low density sintered body would not be considered desirable because the porosity decreases physical properties. However, in this case it is desirable because the sintered body will expand with temperature relative to the anode. The expansion will increase contact pressure to give a low resistance joint but, since the porous sintered body is weak, stresses will not be so high that the ceramic-containing anode cracks.

An increase in density may be obtained in accordance with an embodiment of the present invention by using a trimodal distribution of particulate connector material 16 consisting of three approximately monosized particle size distributions where the ratios of diameters are at least 16:4:1, preferably at least 100:10:1. It should be noted that the smallest particles size may be larger than 20 microns, preferably larger than 44 microns, since smaller particles may not flow well.

The conductor rod 14 may be solid or hollow, and may be made of any suitable electrically conductive material such as nickel, Inconel and/or steel. The diameter of the rod 14 may typically range from 10 to 100 mm, preferably from 12 to 50 mm, depending on the current to be carried by the rod and the size of the surrounding anode. Steel and nickel can be protected from the oxidizing and fluoride-containing atmosphere inside the electrolysis cell by coating or cladding with a corrosion-resistant alloy such as Inconel. The diameter of the rod 14 is based on the amount of current that the anode is designed to carry. The goal is to minimize the voltage drop through the rod without losing too much heat. For example, if the anode is designed to carry 90 amps, a nickel rod with a diameter range of from 0.5 to 0.75 inch (1.3 to 1.9 cm) is suitable. In this case, the voltage drop would be approximately 0.05–0.12 volts.

The seal 18 may comprise a castable ceramic or cermet plug as the primary seal. For example, the seal may comprise a castable ceramic or cermet containing $Al_2O_3$, $SiO_2$, MgO, CaO, $Na_2O$ and the like. A suitable material for a three-inch anode is fine-grain Beta 70 castable material sold by Permatech. The plug may be cast in place or pre-cast and screwed into the anode. If cast in place, an accelerant may be added to reduce the curing time. This seal also provides mechanical support for the anode by transferring the weight of the anode to the conductor rod. An optional secondary seal, e.g., comprising a one-inch layer of metal powder, may reduce the infiltration of air into the connection. For example, if the layer consists of −150+325 mesh copper powder, the top of the layer may oxidize to a depth of about 0.25 inch after 100 hours. When the copper powder oxides, it swells and improves the seal with respect to leakage.

The present inert anode connector assemblies 10 may be made by pouring the loose particulate connector material 16 into the inert anode 12. Preferably, the rod 14 is inserted into the inert anode 12 before the loose particulate connector material 16 is added. However, the rod 14 may be inserted in the inert anode 12 after the anode is filled with the loose particulate connector material 16. In this case, the rod 16 may be provided with a pointed tip (not shown) in order to help drive the rod into the particulate connector material. The anode 12 may optionally be vibrated during filling, or after it is filled with the loose particulate connector material 16. The loose particulate connector material 16 is preferably not pressed, compacted or otherwise subjected to pressure during fabrication of the inert anode assembly 10. Thus, the particulate connector material 16 shown in FIG. 1 may remain loose or non-compacted until it is sintered in-situ.

The loose particulate connector material 16 may be sintered in order to increase electrical conductivity between the rod 14 and the inert anode 12. In a preferred embodiment, the loose particulate material 16 is at least partially sintered in-situ when subjected to the elevated temperature achieved during pre-heating or during operation of the electrolytic metal production cell, e.g., at an aluminum smelting cell temperature of from about 800 to about 1,000° C. Alternatively, the loose particulate connector material 16 may be sintered prior to installation in the aluminum production cell. In this embodiment, suitable sintering temperatures typically range from about 600 to about 1,200° C., depending on the type of particulate connector material. Sintering times of from about 1 to about 100 hours or more may be used. The sintering atmosphere may comprise air, nitrogen or argon, with a controlled amount of oxygen.

In order to obtain a low resistance electrical connection by sintering and brazing, it may be necessary to maintain a slightly reducing atmosphere inside the anode. This can be done by purging with Ar or $N_2$. Thermodynamic equilibrium with Fe and C will maintain a sufficiently low $Po_2$ so that the metal particles do not oxidize and the brazing alloy wets the anode material. For example, excess copper powder, carbon felt and iron powder of steel wool can be used as oxygen getters. Excess copper powder reacts with $O_2$ at a low temperature while iron/steel reacts at intermediate temperatures and carbon reacts at high temperatures.

In one embodiment, after fabricating the anode assembly 10, but before putting it in service, it may be slowly preheated from room temperature to about 950° C. To avoid cracking of the anode due to thermal shock, the heating rate is typically about 10 to 50° C./hr. During this preheat period, the loose particles of the connector material 16 sinter into a solid but porous body. The particulate material has a particle size distribution that avoids shrinkage during sintering, thereby maintaining pressure contact with the inner surfaces of the anode and good electrical connection.

Figure 2:
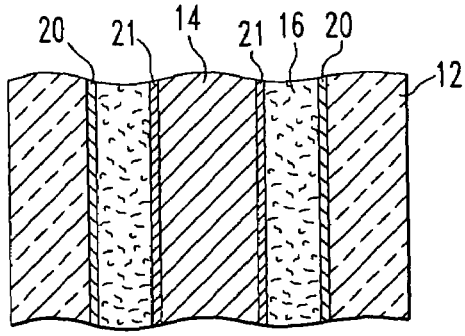
FIG. 2 is a side sectional view of an inert anode electrical connection in accordance with another embodiment of the present invention.

FIG. 2 schematically illustrates a portion of an inert anode assembly in accordance with another embodiment of the present invention. In this embodiment, the inner surface of the inert anode 12 is at least partially covered with a conductive coating 20. The outer surface of the conductor rod 14 is at least partially covered with a conductive coating 21. Although both the anode 12 and rod 14 are coated in the embodiment shown in FIG. 2, the coating may only be provided on either the anode 12 or the rod 14.

The coatings 20 and 21 may be made of Cu, Ag, Sn and/or Ni, with Cu, Ag/Cu eutectic alloy and Ag/Cu/Sn alloy being particularly preferred. Any suitable thickness may be used for each coating 20 and 21, such as from about 0.01 to about 1 mm. A binder, such as a conventional water-based brazing binder, may be used in the coatings. The coatings may be applied by techniques such as spraying, painting, swabbing, electroplating and the like.

The metallization layer(s) 20 and 21 may comprise a small amount, up to 5 percent, but preferably 3 percent, of a reactive element, such as Sn, Ti, Al, Fe, Si or Mn added to the Ag, Cu or Ni. The reactive element takes part in a displacement reaction that, in effect, slightly reduces the anode material and oxidizes the metallizing layer. This reaction improves the ceramic-metal bond. The reactive element may not be on the conductor rod. For example, the walls may be preconditioned by Ni plating (electroless or standard) or by superficial induction of the NiO to Ni using a carbonaceous coating.

An improvement in the electrical connection may thus be obtained through the use of the coatings 20 and 21 by making a metallurgical bond between the anode 12 and the sintered particulate connector material 16. For example, the coating 20 may be a brazing material or other suitable material 20 that melts just as the particulate connector material 16 sinters. The result is a liquid phase sintering process that causes the particulate connector material 16 to sinter against the anode surface 12 rather than pull away to densify the compact. As a particular example, an Ag—Cu eutectic foil may be used. The particulate connector material 16 and/or coatings 20 and 21 may be alloyed to adjust their sintering or melting temperatures. For example, Sn may be added to a Cu brazing alloy in order to reduce the melting point of the brazing alloy so that melting and sintering temperatures are matched. A preferred brazing alloy is the Ag—Cu eutectic alloy (72 percent Ag, 28 percent Cu) with an addition of 1–5 percent Sn. The melting point of the brazing alloy can be varied by adjusting the amount of Sn. For example, a brazing paste can be made by mixing the two powders with a binder and applying with a paint brush.

The inert anode 12 may be made of any suitable material such as ceramic, metal or ceramic/metal composite (cermet). Ceramic materials include metal oxides such as nickel, iron, aluminum, zinc, copper and/or cobalt oxides that have acceptable electrical conductivity at the operating temperature of the cell. For example, nickel ferrites with optional additions of zinc, cobalt and/or aluminum oxides may be used as the ceramic material, or as the ceramic phase of the cermet material. The optional metal phase of the anode material may include Cu, Ni, Ag and/or noble metals such as Pt, Pd and the like. Some examples of suitable inert anode materials are disclosed in U.S. Pat. Nos. 6,217,739, 6,372,119, 6,416,649, 6,423,204 and 6,423,195.

The inert anode may be formed by techniques such as powder sintering, sol-gel processes, chemical processes, co-precipitation, slip casting and spray forming. The starting materials may be provided in the form of metal oxides, nitrates, halides and the like. For example, the inert anodes may be formed by powder techniques in which powders comprising metal oxides, such as nickel, iron, aluminum, zinc, copper and/or cobalt oxides and any metal additives or dopants are pressed and sintered. The inert anode may comprise a monolithic component of such materials, or may comprise a coated substrate of such materials.

As a particular example, nickel oxide, iron oxide and optional aluminum oxide, zinc oxide or cobalt oxide starting powders, e.g., NiO, $Fe_2O_3$, $Al_2O_3$, ZnO, CuO and/or CoO, may be blended in a mixer. The blended ceramic powders may be ground to a smaller size before being transferred to a furnace where they are calcined, e.g., for 0.1 to 12 hours at 1,050 to 1,250° C. The oxide mixture may be ground in a ball mill to an average particle size of approximately 10 microns. The fine oxide particles may be blended with a polymeric binder/plasticizer and water to make a slurry. If a cermet anode material is desired, metal powders such as Cu, Ag, Pt and/or Pd may be added to the oxide powder slurry. About 0.1–10 parts by weight of an organic polymeric binder may be added to 100 parts by weight of the oxide and optional metal particles. Some suitable binders include polyvinyl alcohol, acrylic polymers, polyglycols, polyvinyl acetate, polyisobutylene, polycarbonates, polystyrene, polyacrylates, and mixtures and copolymers thereof. The slurry may contain, e.g., about 60 weight percent solids and about 40 weight percent water. Spray drying the slurry produces dry agglomerates of the oxides, optional metals and binders. The spray dried material may be pressed, for example, at 10,000 to 40,000 psi, into the present anode shapes. A pressure of about 20,000 psi is particularly suitable for many applications.

The pressed shapes may be sintered in an oxygen-containing atmosphere such as air, or in argon/oxygen, nitrogen/oxygen, $H_2/H_2O$ or $CO/CO_2$ gas mixtures, as well as nitrogen. Oxide sintering temperatures of about 1,200–1,650° C. may be suitable. For example, the furnace may be operated at about 1,350–1,550° C. for 2–4 hours. The sintering process burns out any polymeric binder from the anode shapes.

The following examples illustrate various aspects of the present invention, and are not intended to limit the scope of the invention.

EXAMPLE 1

An inert anode connector assembly similar to that shown in FIG. 1 was made as follows. A cup-shaped anode made of $NiFe_2O_4$ ceramic having a height of 250 mm and a diameter of 80 mm was fitted with a connector rod made of nickel having a diameter of 19 mm. The inner wall of the anode was coated with copper paint. The gap between the connector rod and the inner surface of the cup-shaped anode was 9.5 mm. Particulate connector material comprising Cu having a monomodal particle size distribution and an average particle size of 0.8 mm was poured into the gap to a height of about 200 mm. A seal comprising alumina-silica castable was provided inside the upper portion of the anode as shown in FIG. 1. The assembly was then pre-heated to a temperature of about 960° C. and immersed in an electrolytic bath of an aluminum production cell at a temperature of 960° C. to thereby sinter the particulate connector material. Table 1 summarizes the characteristics of the anode (Assembly No. 1)

Several additional anode connector assemblies similar to the Assembly No. 1 described in Example 1 were fabricated. Details of the additional anode assemblies are shown below in Table 1.

TABLE 1

Particulate Anode Connections

| Assembly No. | Particle Composition | Particle Size Distribution* | Particle Size | Gap Size (mm) |
|---|---|---|---|---|
| 1 | Cu | M | −10 to +20 mesh | 9.5 |
| 2 | Cu | B | −10 to +20 mesh; −150 to +325 mesh | 9.5 |
| 3 | Cu | T | 0.0625 to 0.25 inch; −30 to +40 mesh; −100 to +325 mesh | 54 |
| 4 | Ni | M | 0.8 mm | 9.5 |
| 5 | Ni | B | 1 to 6 mm; −170 to +325 mesh | 54 |
| 6 | Ni | T | 0.25 to 0.625 inch; −30 to +40 mesh; −170 to +325 mesh | 54 |

*M = monomodal; B = bimodal; T = trimodal

EXAMPLE 2

A voltage drop test was used to evaluate connections fabricated as described in Example 1. In order to eliminate the effects of electrolysis on voltage drop, the anode was tested in a furnace that operated at the same temperature as an electrolysis cell but without bath. The furnace had holes at the top and bottom, to allow passage of the anode conductor rod and another conductor rod attached to the bottom of the anode. The leads from a constant current DC power supply were connected to the ends of the two conductor rods. The electrical connection at the bottom of the anode was made with an Inconel can partially filled with copper or nickel shot or powder. The bottom conductor rod was welded to the bottom of the can. The space between the can and the anode was filled in a similar manner to the inner connection; i.e., the outside of the anode was metallized and the one-inch space below the anode was filled with Cu or Ni shot and the annulus, which was typically 2 inches high, was filled with Cu or Ni powder. A purge ring manifold made from Inconel tubing was positioned above the Cu or Ni powder and the space above that, at the top of the can, was packed with refractory blanket or rope.

The furnace temperature was ramped at 10–25° C./hr to 960–970° C. and then a constant current was passed between the top of the anode connector rod and the bottom of the conductor rod extending from the can. The base current was approximately the average current at which an anode of that size would operate in a commercial electrolysis cell. After 100 hours at the base current, the current was ramped up to three times (3×) the base current, held for an hour, and then ramped back down to the base current. This portion of the test was designed to simulate an upset in an electrolysis cell that might cause high current to flow in a few anodes. Two test criteria were considered. First, the resistance of the anode plus connection should be near the theoretical value considering the resistivity of the conductor rod and anode material. That is, the interface voltages should be very small. The voltage may decrease with time as the connection improves by diffusion but should not increase. Second, the final voltage after the 3× cycle should be very close to the initial voltage. In addition, the temperature within the anode should not exceed the melting point of the connector material, e.g., 1,080° C. for Cu.

Figure 5:
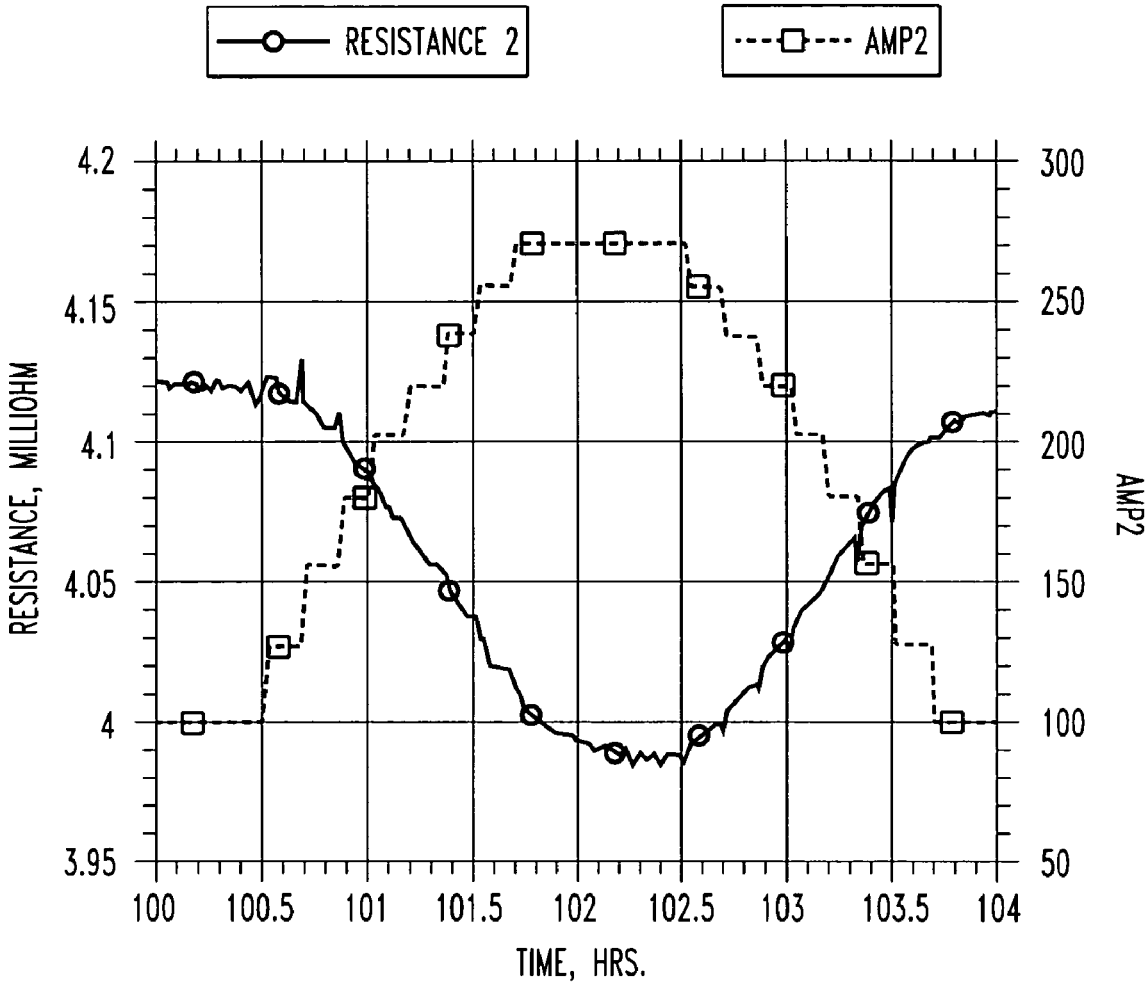
FIG. 5 is a graph of resistance and applied current through an anode connection versus time, illustrating that the anode connection survived high current levels.
Figure 6:
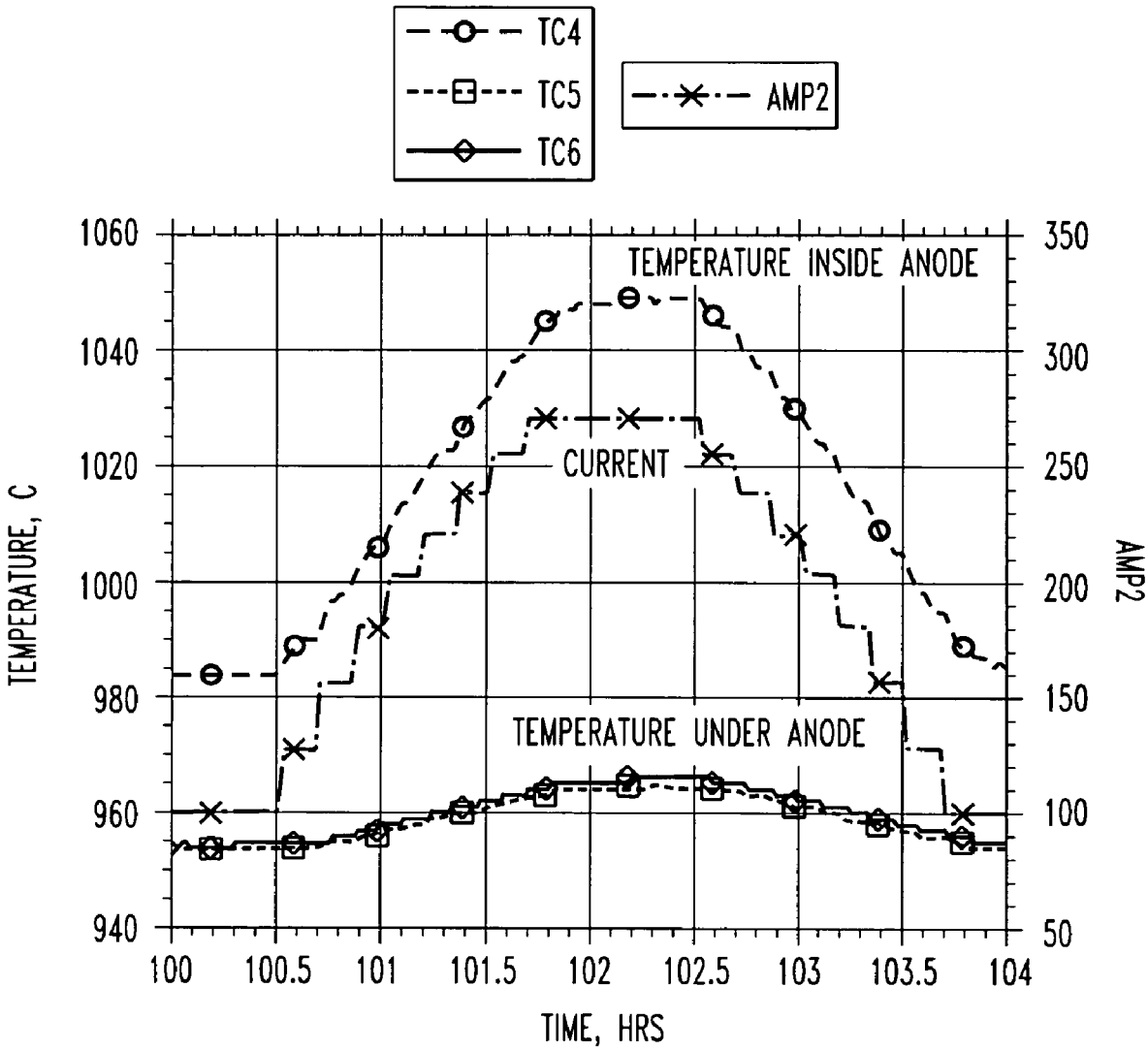
FIG. 6 is a graph of anode temperature and applied current versus time, illustrating that the anode survived high temperature operation.
Figure 7:
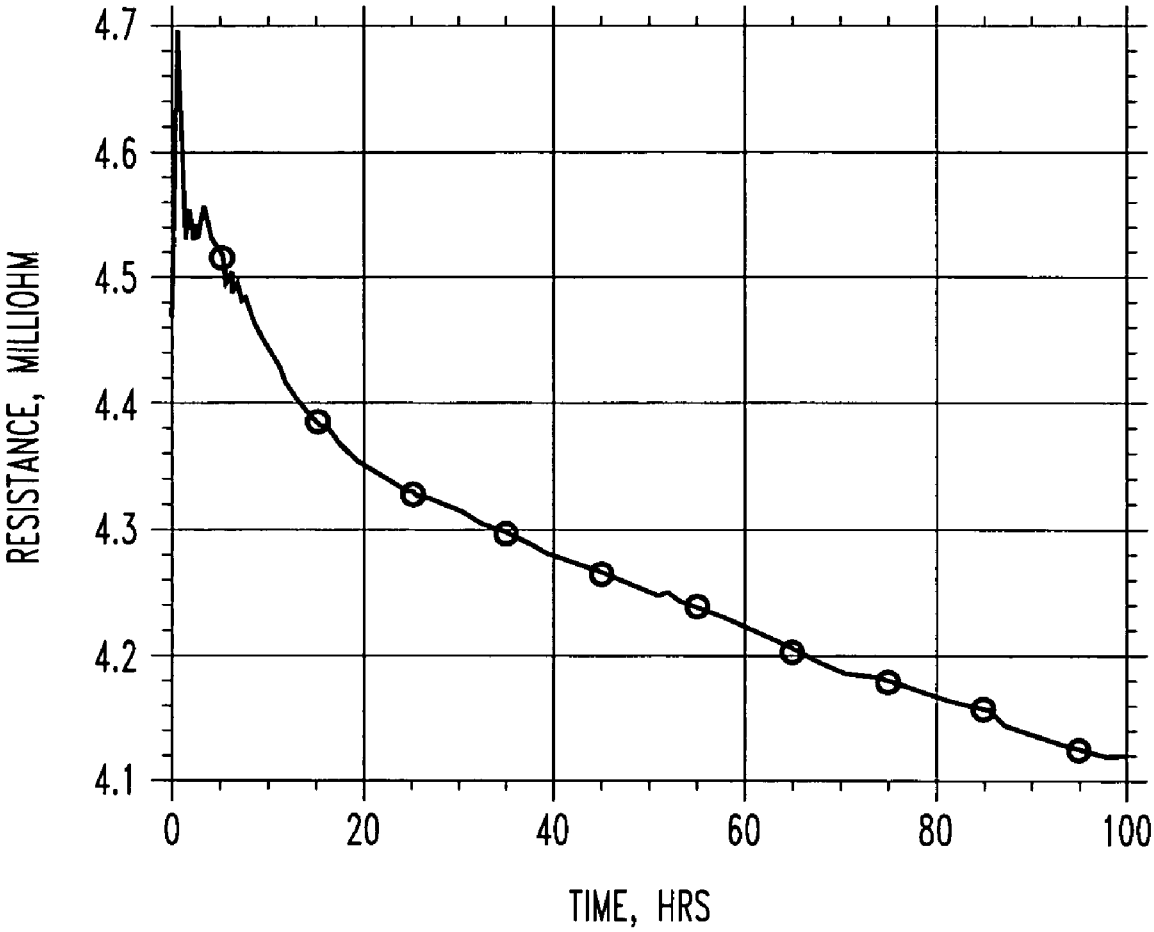
FIG. 7 is a graph of anode connection resistance versus operation time, illustrating a decrease in connection resistance during operation of the anode.

Results of the tests are shown in FIGS. 5–7. FIG. 5 is a graph of resistance and applied current through an anode connection versus time, demonstrating that the anode connection survived high current levels. FIG. 6 is a graph of anode temperature and applied current versus time, demonstrating that the anode survived high temperature operation. FIG. 7 is a graph of anode connection resistance versus operation time, demonstrating a decrease in connection resistance during operation of the anode.

The present inert anode assemblies are particularly useful in electrolytic cells for aluminum production operated at temperatures in the range of about 800–1,000° C. A typical cell operates at a temperature of about 900–980° C., for example, about 930–970° C. An electric current is passed between the inert anodes and at least one cathode through a molten salt bath comprising an electrolyte and an oxide of the metal to be collected. In a preferred cell for aluminum production, the electrolyte comprises aluminum fluoride and sodium fluoride and the metal oxide is alumina. The weight ratio of sodium fluoride to aluminum fluoride is about 0.7 to 1.25, preferably about 1.0 to 1.20. The electrolyte may also contain calcium fluoride, lithium fluoride and/or magnesium fluoride.

Having described the presently preferred embodiments, it is to be understood that the invention may be otherwise embodied within the scope of the appended claims.

What is claimed is:

1. An inert anode assembly comprising:

an inert anode having a cavity;

an electrically conductive rod at least partially disposed in the cavity defining a gap between the inert anode and the conductive rod; and particulate conductor material at least partially filling the gap, wherein the particulate conductor material comprises at least one metal selected from Cu, Ag and Ni.

2. The inert anode assembly of claim 1, wherein the particulate conductor material has an average particle size of from about 0.05 to about 5 mm.

3. The inert anode assembly of claim 1, wherein the particulate conductor material has a monomodal particle size distribution.

4. The inert anode assembly of claim 1, wherein the particulate conductor material comprises multiple particle size distributions.

5. The inert anode assembly of claim 1, wherein the particulate conductor material has a bimodal size distribution.

6. The inert anode assembly of claim 1, wherein the particulate conductor material has a trimodal size distribution.

7. The inert anode assembly of claim 1, wherein the particulate conductor material has a density of less than 95 percent of a theoretical density of the conductor material.

8. The inert anode assembly of claim 1, wherein the particulate conductor material has a density of from about 60 to about 90 percent of a theoretical density of the conductor material.

9. The inert anode assembly of claim 1, wherein the particulate conductor material is at least partially sintered.

10. The inert anode assembly of claim 1, wherein the gap is from about 0.1 to 15 cm.

11. The inert anode assembly of claim 1, wherein the gap is from about 0.5 to about 5 times a diameter of the conductive rod.

12. The inert anode assembly of claim 1, further comprising at least one conductive coating between the inert anode and the particulate conductor material and/or between the conductive rod and the particulate conductor material.

13. The inert anode assembly of claim 12, wherein the at least one conductive coating comprises at least one metal selected from Cu, Ag, Sn and Ni.

14. The inert anode assembly of claim 12, wherein the at least one conductive coating has a thickness of from about 0.01 to about 1 mm.

15. The inert anode assembly of claim 1, wherein the inert anode comprises a ceramic.

16. The inert anode assembly of claim 1, wherein the inert anode is substantially cylindrical and cup shaped.

17. The inert anode assembly of claim 1, wherein the inert anode has an outer diameter of from about 3 to about 30 cm, and a height of from about 10 to about 40 cm.

18. The inert anode assembly of claim 1, wherein the conductive rod comprises at least one metal selected from Ni, Cu and Fe.

19. The inert anode assembly of claim 1, wherein the conductive rod has an outer diameter of from about 10 to about 100 mm.

20. The inert anode assembly of claim 1, further comprising a seal between the conductive rod and the inert anode above the particulate conductor material.

21. The inert anode assembly of claim 20, wherein the seal comprises a castable ceramic material.

22. The inert anode assembly of claim 1, wherein said particulate conductor material comprises at least one of Fe, Al, bronze, MONEL, and INCONEL.

23. The inert anode assembly of claim 1, wherein said particulate conductor material has a density of less than 90 percent of a theoretical density of the conductor material.

24. A method of making an inert anode assembly comprising:

providing an inert anode comprising a cavity;

providing an electrically conductive rod at least partially in the cavity with a gap between the inert anode and the conductive rod; and providing a particulate connector material in the gap, wherein the particulate connector material is poured into the gap in loose particulate form.

25. The method of claim 24, wherein the particulate connector material has a density of from about 50 to about 95 percent of a theoretical density of the connector material.

26. The method of claim 24, further comprising sintering the particulate connector material.

27. The method of claim 26, wherein the particulate connector material is sintered during use of the inert anode assembly in an electrolytic aluminum production cell.

28. The method of claim 26, wherein the particulate connector material is sintered prior to use of the inert anode assembly in an electrolytic aluminum production cell.

29. The method of claim 26, wherein the sintering is performed at a temperature of from about 600 to about 1,200 degree C.

30. The method of claim 24, wherein the particulate connector material comprises at least one metal selected from Cu, Ag and Ni.

31. The method of claim 24, wherein the particulate connector material has an average particle size of from about 0.05 to about 5 mm.

32. The method of claim 24, wherein the particulate connector material has a monomodal particle size distribution.

33. The method of claim 24, wherein the particulate connector material comprises multiple particle size distributions.

34. The method of claim 24, wherein the gap is from about 0.1 to about 15 cm.

35. The method of claim 24, further comprising providing a conductive coating between the inert anode and the particulate connector material and/or between the conductive rod and the particulate connector material.

36. The method of claim 24, wherein the inert anode comprises a ceramic and the conductive rod comprises a metal.

37. The method of claim 24, further comprising providing a seal between the conductive rod and the inert anode above the particulate connector material.

38. A method of producing aluminum comprising:

passing current between an inert anode assembly and a cathode through a molten salt bath comprising an electrolyte and aluminum oxide; and recovering aluminum from the molten salt bath, wherein the inert anode assembly comprises:

an inert anode having a cavity;

an electrically conductive rod at least partially disposed in the cavity defining a gap between the inert anode and the conductive rod; and particulate conductor material at least partially filling the gap.

39. The method of claim 38, wherein the particulate conductor material has a density of from about 50 to about 95 percent of a theoretical density of the conductor material.

40. The method of claim 38, further comprising sintering the particulate conductor material during the inert anode production process.

* * * * *